US009802405B2

(12) United States Patent
Hollands et al.

(10) Patent No.: US 9,802,405 B2
(45) Date of Patent: Oct. 31, 2017

(54) INKJET PRINTHEAD

(71) Applicant: Océ-Technologies B.V., Venlo (NL)

(72) Inventors: Peter J. Hollands, Venlo (NL); Marco T. R. Moens, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/374,627

(22) Filed: Dec. 9, 2016

(65) Prior Publication Data

US 2017/0182775 A1 Jun. 29, 2017

(30) Foreign Application Priority Data

Dec. 23, 2015 (EP) ..... 15202313
Feb. 23, 2016 (EP) ..... 16156823

(51) Int. Cl.
*B41J 2/14* (2006.01)

(52) U.S. Cl.
CPC ..... *B41J 2/14201* (2013.01); *B41J 2/14233* (2013.01); *B41J 2002/14306* (2013.01); *B41J 2002/14362* (2013.01); *B41J 2002/14419* (2013.01); *B41J 2202/08* (2013.01)

(58) Field of Classification Search
CPC ..... B41J 2/14201; B41J 2002/14306; B41J 2002/14419
See application file for complete search history.

(56) References Cited

U.S. PATENT DOCUMENTS

2003/0156173 A1 8/2003 Yamaguchi et al.
2004/0114005 A1 6/2004 Okazawa et al.
2006/0284914 A1 12/2006 Murakami et al.
2007/0279455 A1 12/2007 Karlinski et al.
2008/0036816 A1 2/2008 Nishida
2010/0328409 A1* 12/2010 Matsufuji ..... B41J 2/14233 347/93
2012/0120158 A1 5/2012 Sakai et al.

FOREIGN PATENT DOCUMENTS

EP 1586453 A2 10/2005

OTHER PUBLICATIONS

European Search Report dated May 11, 2017; pp. 1-2.

* cited by examiner

*Primary Examiner* — Geoffrey Mruk
(74) *Attorney, Agent, or Firm* — Birch, Stewart, Kolasch & Birch, LLP

(57) ABSTRACT

In an inkjet print head for generating a droplet of ink, the inkjet print head comprises an ink supply substrate, a droplet forming unit arranged on the ink supply substrate and an intermediate element arranged between the ink supply substrate and the droplet forming unit. The intermediate element has a first element surface on which the droplet forming unit is arranged and the intermediate element has a second element surface opposite to the first element surface. The intermediate element is supported on the ink supply substrate at the second element surface. The intermediate element is provided with a number of support protrusions at the second element surface. Due to the support protrusions, differences in coefficient of thermal expansion of the droplet forming unit and the ink supply substrate may reduce an effect of a resulting deformation of the droplet forming unit on an image quality.

7 Claims, 5 Drawing Sheets

INKJET PRINTHEAD

FIELD OF THE INVENTION

The present invention generally pertains to an inkjet print head comprising a droplet forming unit arranged on an ink supply substrate.

BACKGROUND OF THE INVENTION

In a known inkjet print head, a droplet forming unit is be manufactured by lithographic techniques in a layered silicon plate, thus forming a MEMS chip. Such a MEMS chip based inkjet print head is difficult to handle and ink needs to be supplied to the MEMS chip. Thereto, it is known to arrange the MEMS chip on an ink supply substrate which provides for a fluidic coupling to an ink reservoir and which enables handling and positioning of the inkjet print head in an inkjet printer assembly.

The ink supply substrate is commonly not made of silicon, which results in the MEMS chip and the ink supply substrate having different respective coefficients of thermal expansion. As a consequence, when operating the inkjet print head at a temperature different than the temperature at which the MEMS chip was adhered to the ink supply substrate, the MEMS chip will have expanded or contracted with an amount different than the ink supply substrate. The different amount of expansion or contraction affects the shape of the ink supply substrate and/or the MEMS chip. Since it may be expected that the ink supply substrate is stiffer than the MEMS chip, the MEMS chip will deform significantly, while any deformation in the ink supply substrate will be limited.

Any deformation in the MEMS droplet forming unit will affect the droplet forming. For example, a direction of droplet ejection may be deviated. In another example, the MEMS droplet forming unit may be a piezo-actuated droplet forming unit using a piezo actuator arranged on a membrane. Deformation of the MEMS chip will then result in a change in stress in the membrane, but not equally for all membranes, resulting in different droplet ejection properties, such as different droplet speed and/or different droplet size and/or different droplet directions.

SUMMARY OF THE INVENTION

It is desirable to have an inkjet print head with a droplet forming unit on an ink supply substrate, in which a deformation of the droplet forming unit does not result in unacceptable image quality.

The present invention provides thereto an inkjet print head for generating a droplet of ink, the inkjet print head comprising an ink supply substrate, a droplet forming unit arranged on the ink supply substrate and an intermediate element arranged between the ink supply substrate and the droplet forming unit. The intermediate element has a first element surface on which the droplet forming unit is arranged and the intermediate element has a second element surface opposite to the first element surface, wherein the intermediate element is supported on the ink supply substrate at the second element surface. In accordance with the present invention, the intermediate element is provided with a number of support protrusions at the second element surface. The droplet forming unit comprises a number of droplet ejection units, each droplet ejection unit comprising an ink flow path extending between an ink inlet port and an orifice, a piezoelectric actuator being arranged in operative communication with the ink flow path for generating a pressure wave in the ink in the ink flow path. In particular, the droplet forming unit may be made of a silicon substrate processed by lithographic MEMS processing.

The support protrusions have an increased flexibility for bending laterally. Thus, the support protrusions, arranged between the ink supply substrate and the droplet forming unit, are enabled to compensate for a different amount of expansion/contraction by laterally deforming.

In an embodiment, the droplet forming unit has an ink inlet surface, in which ink inlet surface an ink inlet port for receiving ink from the ink supply substrate is arranged. In such embodiment, the ink inlet surface is arranged on the first element surface of the intermediate element. The intermediate element may be configured to enable a flow of ink into the ink inlet port arranged in the ink inlet surface, while the ink inlet surface is mounted on the intermediate element. For example, in an exemplary embodiment, the intermediate element comprises an ink supply opening at the first element surface and the ink supply opening forms a manifold chamber for supplying ink to the ink inlet port of the droplet forming unit.

In a further embodiment, the ink inlet surface of the droplet forming unit has an outer portion surrounding an ink inlet port portion. The ink inlet portion is defined by each ink inlet port being arranged within the ink inlet portion. The support protrusions are arranged opposing said outer portion. Hence, the support protrusions are arranged in a portion where no ink inlet ports are provided. More in general, the support protrusions may be arranged at a circumference of the droplet forming unit.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
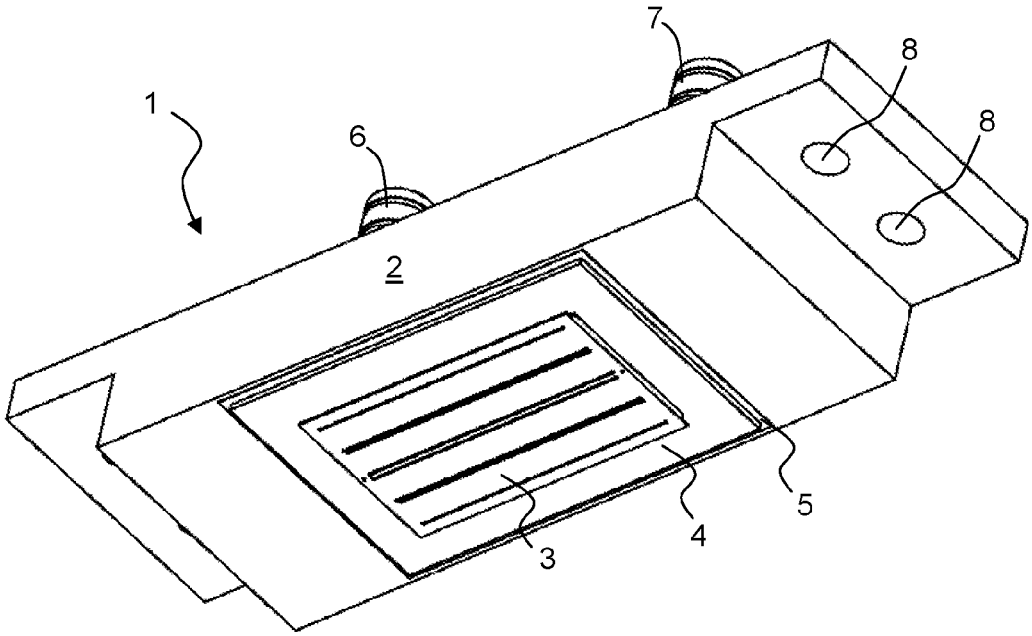
FIG. 1A shows a perspective view of an embodiment of an inkjet print head.

The present invention will now be described with reference to the accompanying drawings, wherein the same reference numerals have been used to identify the same or similar elements throughout the several views.

Figure 1B:
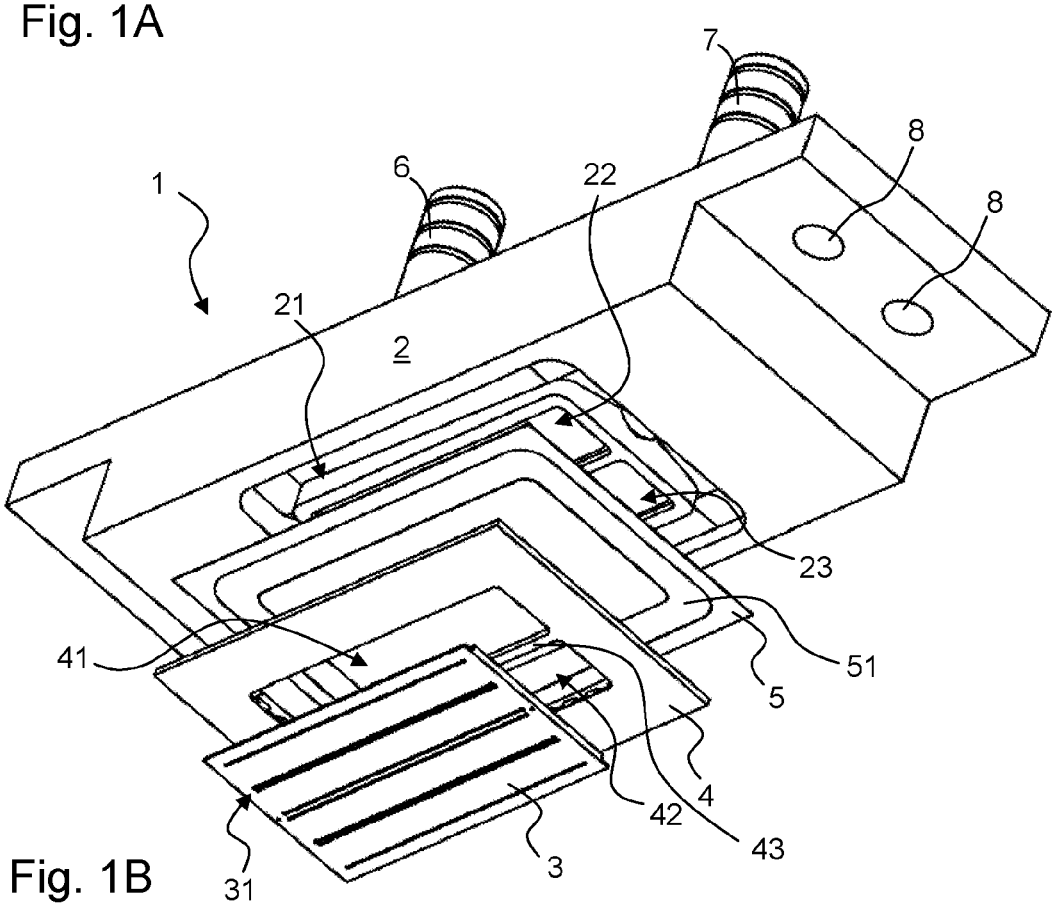
FIG. 1B shows an exploded perspective view of the embodiment according to FIG. 1A.

FIGS. 1A and 1B illustrate an inkjet print head 1 comprising an ink supply substrate 2 and a droplet forming unit 3. An intermediate element 4 and a flexible foil 5 are interposed between the ink supply substrate 2 and the droplet forming unit 3. In this embodiment, the ink supply substrate 2 is provided with two ink connectors, in particular an ink supply connector 6 and an ink return connector 7 enabling a continuous flow of ink through the inkjet print head 1 as elucidated hereinafter in more detail. The ink supply substrate 2 is provided with a suitable number of suitable mounting means, which mounting means are embodied in the illustrated print head as mounting holes 8. Any other kind of mounting means may be employed alternatively or additionally.

In this particular example, the droplet forming unit 3 is embodied as a MEMS (Micro-Electro-Mechanical System) chip constructed from an etchable material such as silicon, in which micro structures, such as ink channels (i.e. ink flow paths), are etched. The ink channels extend between an ink inlet port and an orifice. Further, piezo-electric actuators are provided for generating a pressure wave in the ink channels, wherein the pressure waves are such that a droplet of ink is ejected from the orifice. Such structures and corresponding actuators for generating droplets are well known in the art and are not elucidated herein in more detail. It is noted that for the present invention, the droplet forming unit may be formed from any suitable materials using any suitable processing as apparent to those skilled in the art.

The ink supply substrate 2 may be formed from any suitable material. For example, a graphite element may be milled and/or drilled and/or laser ablated to form ink supply structures in the ink supply substrate. As another example, suitable plastics may be used to form the ink supply substrate 2 as well. In particular, the intermediate element 4 and the flexible foil 5 thermally isolate the droplet forming unit 3 from the ink supply substrate 2. Selecting suitable materials and/or shape of the intermediate element 4 enables to provide for design freedom for the ink supply substrate 2 as further elucidated hereinafter.

Referring in particular to FIG. 1B, the droplet forming unit 3 is provided with a number of orifices 31, commonly arranged in a number of rows, wherein the orifices 31 are arranged in a nozzle surface 33 of the droplet forming unit 3. In an ink inlet surface 34 (not shown in FIG. 1B) opposite to the nozzle surface 33, ink inlet ports 32 (not shown in FIG. 1B) are provided. Ink is supplied to the ink inlet ports 32 through the intermediate element 4, which comprises thereto an ink supply opening. More in particular, in the illustrated embodiment, the ink supply opening is divided in two ink supply openings 41, 42 with a support ridge 43 provided therebetween.

The flexible foil 5 is arranged, compared to the droplet forming unit 3, at an opposing surface of the intermediate element 4. The flexible foil 5, the ink supply openings 41, 42 and the droplet forming unit 3 together enclose and form a manifold chamber. The flexible foil 5 has a suitable flexibility for absorbing any pressure waves generated in the ink channels of the droplet forming unit 3 and propagating into the manifold chamber. Such pressure waves are absorbed by the flexible foil 5 thereby preventing cross-talk between different ink channels in the droplet forming unit 3 and thus forming a damper. In order for the flexible foil 5 to function properly as a damper, a distance between the droplet forming unit 3 and the flexible foil 5 needs to be relatively small to prevent that the inertia of the ink in the manifold chamber prevents that the pressure wave arrives at the flexible foil 5. Therefore, a distance between the droplet forming unit 3 and the flexible foil 5 is preferably smaller than 1 mm, more preferably smaller than 500 micron and even more preferably smaller than 400 micron. Of course, too small might lead to insufficient ink supply.

The flexible foil 5 is further provided with a filter area 51, which is, in this embodiment, arranged at a circumference of the ink supply openings 41, 42 in the intermediate element 4. Ink is thus supplied to the manifold chamber through the filter area 51. The filter area 51 may be formed by providing an array of filter holes in the flexible foil 5, for example, wherein the filter holes are made with a predetermined filter hole diameter in order to prevent particles of a predetermined size larger than said diameter to pass through the filter. In another embodiment, a mesh of a woven or a non-woven material may be provided in the filter area 51 instead of the flexible foil 5. If no filter is desired, the filter area 51 may be replaced by an ink supply area having holes of a larger diameter or the flexible foil 5 may be omitted in the filter area 51.

In the ink supply substrate 2, at the location of the filter area 51, an ink supply channel 21 is provided. The ink supply channel 21 is in fluid communication with the ink supply connector 6 and the ink return connector 7. Through the ink supply connector 6 ink is supplied to the ink supply channel 21, where the ink may flow through the filter area 51 into the manifold chamber or the ink may flow to the ink return connector 7 and return to an ink reservoir, depending inter alia on the amount of ink ejected from the droplet forming unit 3.

The ink supply substrate 2 is further provided with a damper recess. In the illustrated embodiment, the damper recess is divided in a first damper recess 22 and a second damper recess 23 corresponding to the ink supply openings 41, 42 in the intermediate element 4. The damper recesses 22, 23 allow the flexible foil 5 to move and thus to absorb the pressure waves.

Figure 2A:
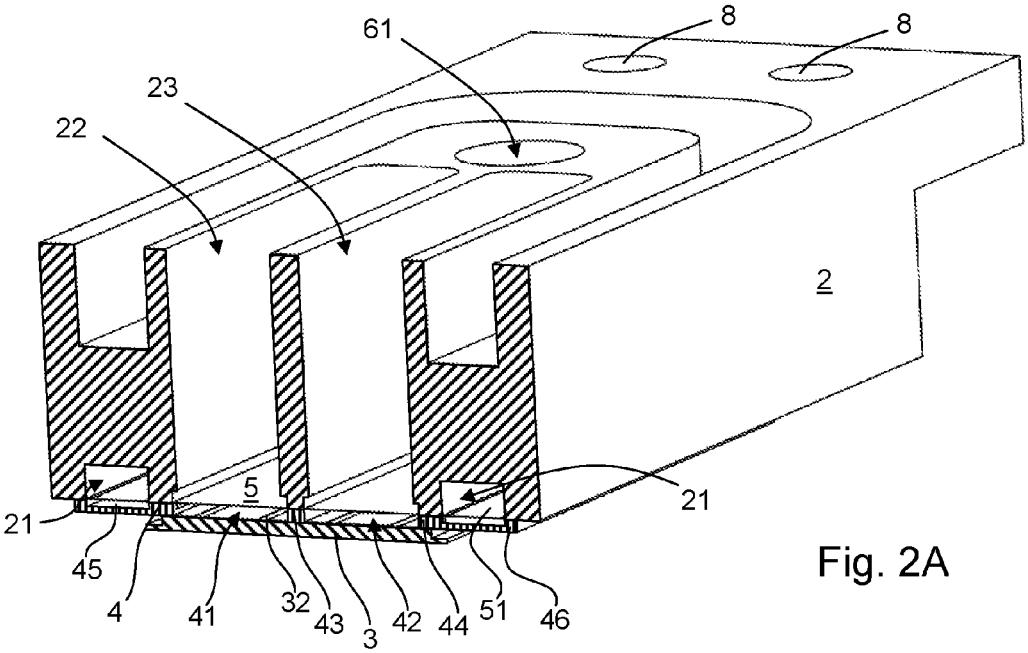
FIG. 2A shows a cross-section of a part of the embodiment of FIG. 1A in a perspective view.

FIGS. 2A-2D provide a number of cross-sectional perspective views for further illustrating the structure of and ink flow in the inkjet print head 1. FIG. 2A shows the ink supply substrate 2 having an ink supply connector channel 61 providing for a fluid connection between the ink supply connector 6 and the ink supply channel 21. Ink provided through the ink supply connector 6 flows through the ink supply connector channel 61 into the ink supply channel 21.

As shown in FIG. 2A, the damper recesses 22, 23 extend through the ink supply substrate 2. This provides for the flexible damper foil 5 never being loaded due to atmospheric pressure changes, which could decrease the compliance of the flexible foil 5. Any other arrangement providing for atmospheric pressure at the outer side (side opposite of the side of the flexible foil 5 forming a flexible wall of the manifold chamber) may be employed as well.

Figure 2D:
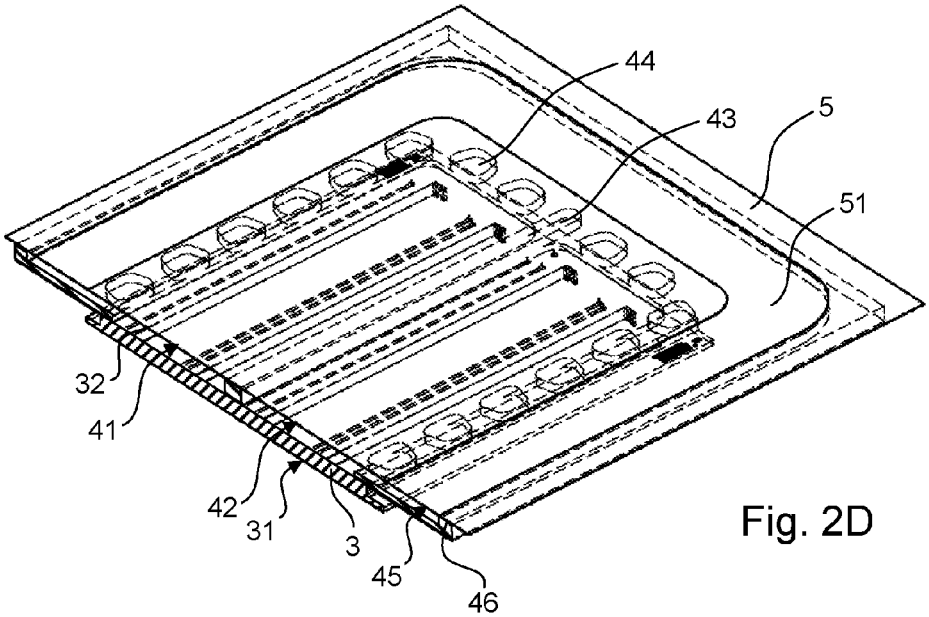
FIG. 2D shows a cross-section of the part of FIG. 2C in another perspective view.
Figure 2B:
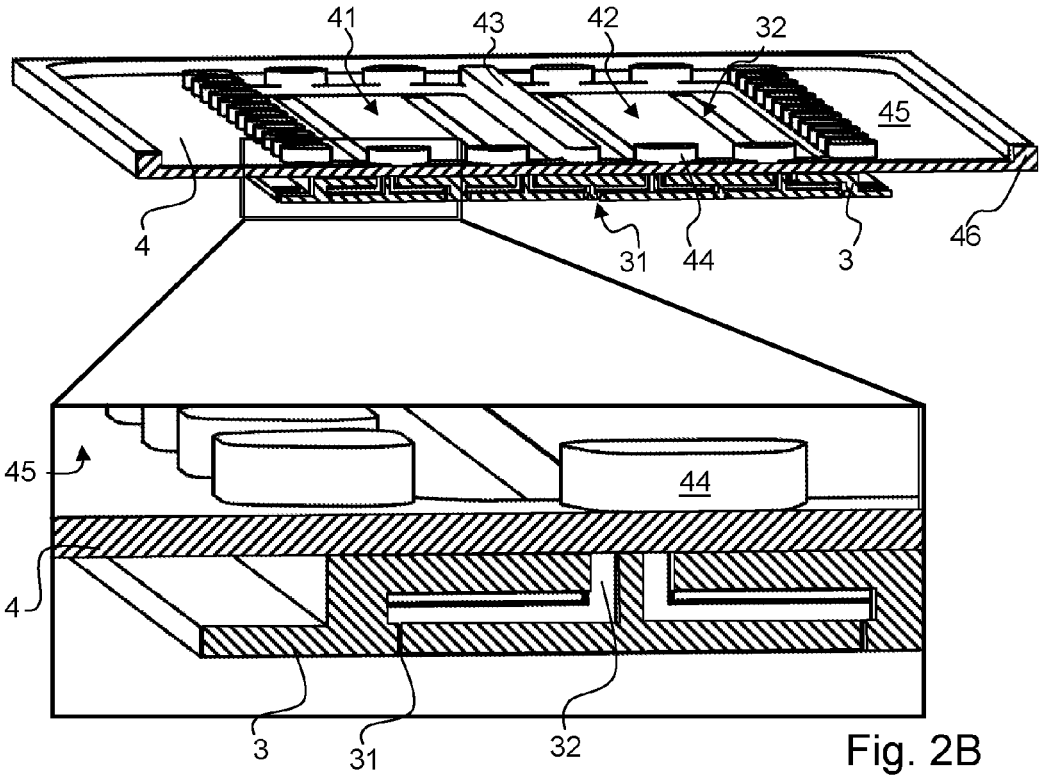
FIG. 2B shows a cross-section of a part of the embodiment of FIG. 1A in a perspective view, including an enlarged section.

The intermediate element 4 and the droplet forming unit 3 are better illustrated in FIG. 2B. The droplet forming unit 3 is illustrated in cross-section, showing the ink channels including the orifice 31 and the ink inlet port 32 in the nozzle surface 33 and the ink inlet surface 34, respectively. The droplet forming unit 3 is arranged on the intermediate element 4 on an outer portion 35 of the ink inlet surface 34. The outer portion 35 of the ink inlet surface 34 is a surface portion where no ink inlet ports 32 are arranged, while said surface portion surrounds the ink inlet ports 32. A surface of the intermediate element 4 on which the droplet forming unit 3 is arranged is substantially flat, except for the ink supply openings 41, 42. An opposite surface of the intermediate element 4 is provided with an edge ridge 46, support protrusions 44, a manifold supply channel 45 and the support ridge 43. Manifold feed openings 47 are provided between the support protrusions 44.

Figure 2C:
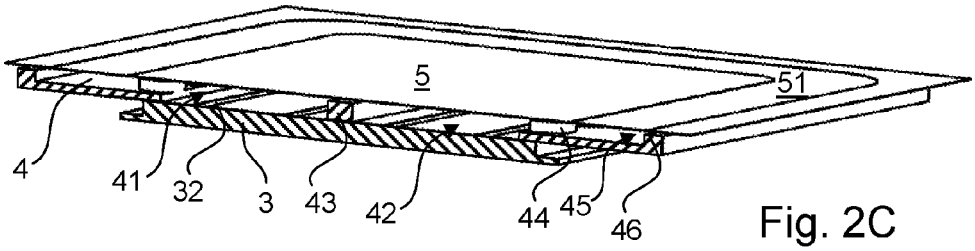
FIG. 2C shows a cross-section of a part of the embodiment of FIG. 1A in a perspective view.

Referring to FIGS. 2C and 2D, the flexible foil 5 is arranged on the edge ridge 46, the support ridge 43 and the support protrusions 44. The filter area 51 is arranged over the manifold supply channel 45. Thus, ink is supplied through the filter area 51 and flows into the manifold supply channel 45. The ink then flows between the support protrusions 44 from all sides into the manifold chamber formed by the supply openings 41, 42.

Figure 3A:
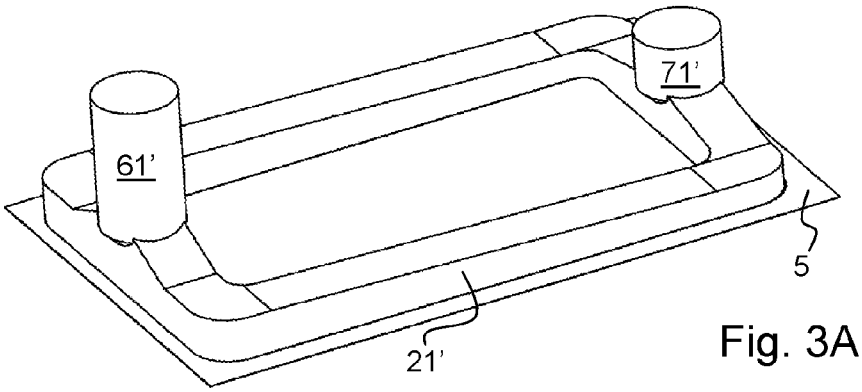
FIG. 3A shows a perspective view of an ink flow path in a part of the embodiment of FIG. 1A.

In FIG. 3A-3D, the ink flow is further illustrated. Referring to FIG. 3A, the flexible foil 5 is shown. Further, the ink supply channel ink 21', i.e. the ink in the ink supply channel 21, is shown. Similarly, the ink supply connector channel ink 61', i.e. the ink in the ink supply connector channel 61, and the ink return connector channel ink 71', i.e. the ink in an ink return connector channel (not shown), are shown. The ink may continuously flow from the ink supply connector 6 through the ink supply channel 21 over the filter area 51 to the ink return connector 7. Any dirt or other particles in the ink as supplied and large enough to cause obstructions in the droplet forming unit 3 may thus be prevented from entering the droplet forming unit 3. Since the filter area 51 is arranged so close to the droplet forming unit 3, a chance that a too large particle gets into the ink in the manifold chamber and into the droplet forming unit 3 is made as small as possible.

Figure 3B:
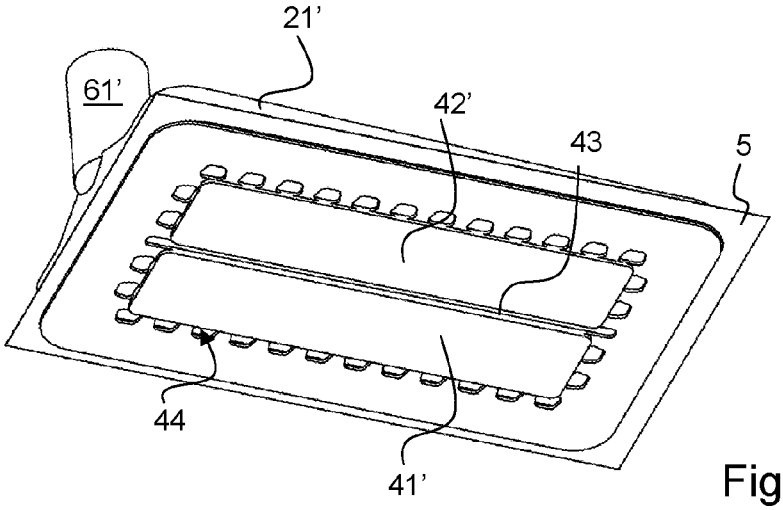
FIG. 3B shows another perspective view of the ink flow path shown in FIG. 3A.

FIG. 3B shows a similar view, but then from the other side of the flexible foil 5. The manifold supply channel ink 45' flows from all sides around the protrusions 44 into the manifold chamber forming the manifold ink 41' and 42'. The support ridge 43 divides the manifold chamber in the two sections 41 and 42. The ink flowing from all sides ensures that there are no dead zones where ink may remain. Ink staying and not being refreshed will eventually result in deterioration due to aging. Aged ink may result in dried ink particles and other potential obstructions and disturbances. Preventing dead zones prevents these kinds of potential problems.

Further, the ink flowing from all sides of the circumference of the manifold chamber into the manifold chamber ensures that any air bubbles downstream of the filter area 51 are transported towards the droplet forming unit 3. Therefore, when applying a purge pressure pulse, i.e. an increased pressure pulse through the ink supply connector 6, purging a relatively large amount of ink through the droplet forming unit 3, the air bubbles will be transported through the droplet forming unit ink channels and through the orifices 31 outwards.

In more detail, the filter area 51 may be provided with filter holes covering about 30% of the filter area 51. In a particular embodiment, the filter holes may have a diameter of about 18 micron at a pitch of about 30 micron and arranged in staggered rows. Taking into account the relatively large filter area 51, which also greatly reduces a flow resistance of the filter, it has been observed that a rinsing action through the ink supply channel 21 induces a flow in the manifold supply channel 45 and even in the ink supply openings 41, 42. Air bubbles in the manifold supply channel 45 and in the ink supply openings 41, 42 (the manifold chamber) are observed to flow towards the ink return connector 7, but these air bubbles do not pass through the filter holes in the filter area 51. Still, such a flow below the filter holes apparently enables to move air bubbles that tend to float against the filter, which allows to subsequently purge these air bubbles through the channels of the droplet forming unit 3. It is noted that the amount of flow generated below the filter depends inter alia also on the amount of ink below the filter. Since in the illustrated embodiment only a thin layer of ink is present, a significant flow may be generated.

Figure 4A:
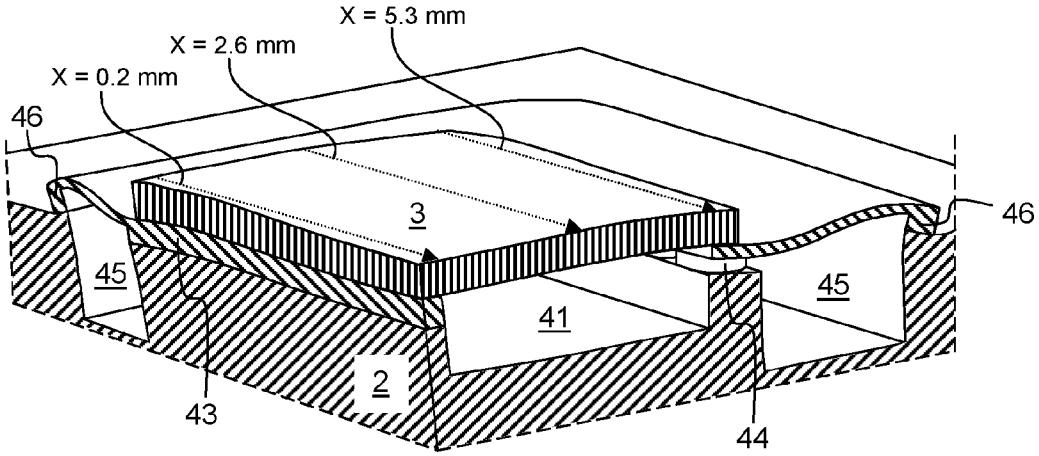
FIG. 4A shows a cross-section of a deformed part of a simulated embodiment of an inkjet print head.
Figure 4B:
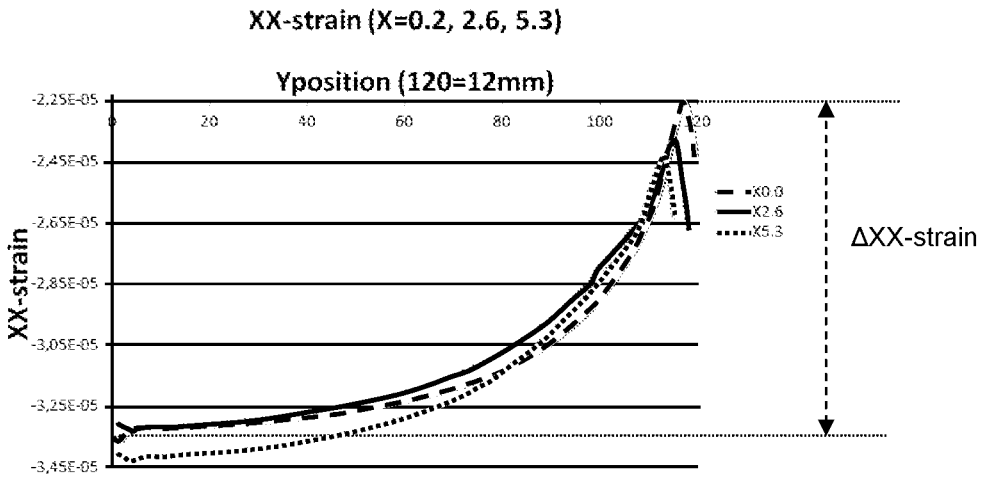
FIG. 4B, 4C each show a graph representing an amount of deformation corresponding to the view shown in FIG. 4A.
Figure 4C:
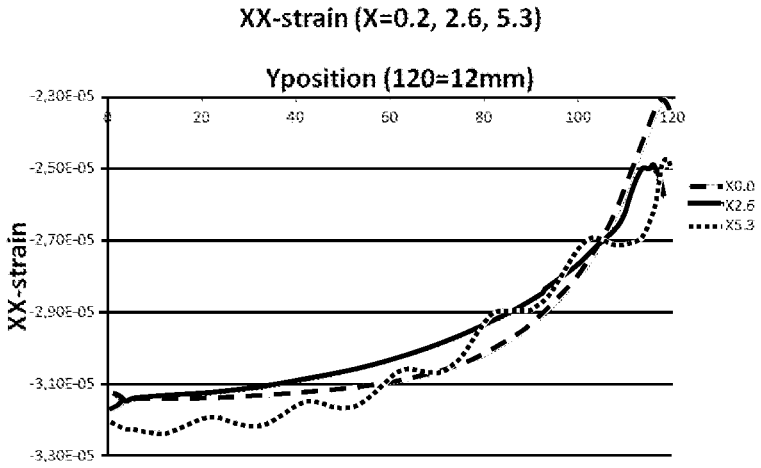

FIG. 4A-4C illustrate simulation results for an assembly of an ink supply substrate 2, an intermediate element 4 and a droplet forming unit 3. In the simulation, the droplet forming unit 3 is presumed to be made of silicon and the intermediate element 4 and the ink supply substrate 2 are made of graphite. The simulated assembly is bonded during manufacturing at an elevated temperature and then cooled. Due to differences in the coefficient of thermal expansion, the silicon and graphite shrink in differing amounts, resulting in a mismatch of dimensions, as is well known in the art. The mismatch in dimensions results in mechanical stress and deformations as is readily apparent from FIG. 4A. Deformations of the droplet forming unit 3 negatively affect droplet formation due to variations in tensions in a membrane forming a flexible wall of a pressure chamber, thereby affecting a resonance frequency of the droplet ejection system; in particular droplet speed and volume may be affected. Due to differences in droplet speed and volume, image quality is deteriorated. Deviations in droplet speed and angle are therefore preferably avoided and therefore deformations of the droplet forming unit 3 are preferably avoided.

In FIG. 4A (illustrating a quarter of the whole model in cross-section), the intermediate element 4 is provided with support protrusions 44. The support protrusions 44 are arranged below the outer portion 35 of the ink inlet surface 34 of the droplet forming unit 3. So, any mechanical stress between the droplet forming unit 3 on the one hand and the intermediate element 4 and the ink supply substrate 2 on the other hand induced by the thermal expansion is mainly localized at the location of the support protrusions 44. FIGS. 4B and 4C illustrate the mechanical strain in the X-direction ('XX-strain') at three lines along the Y-direction at three different X-positions (X=0.2 mm; X=2.6 m; and X=5.3 mm) as indicated in FIG. 4A.

Relevant to the deformation is the difference in strain at different locations. FIG. 4B shows the simulation results for a droplet forming unit 3 arranged on an intermediate element 4 not having support protrusions 44, but having a solid support ridge instead. The difference in strain between a minimum strain and a maximum strain (in FIG. 4B indicated for X=0.2 mm) is about 11 ppm (minimum is about $-3.35*10^{-5}$; maximum is about $-2.25*10^{-5}$). Table I presents the data for all three curves for both solid ridge (FIG. 4B) and support protrusions (FIG. 4C).

TABLE I

| With support ridge (FIG. 4B) | | | | With support protrusions (FIG. 4C) | | |
|---|---|---|---|---|---|---|
| Min [$10^{-5}$] | Max [$10^{-5}$] | Diff. [$10^{-6}$] | | Min [$10^{-5}$] | Max [$10^{-5}$] | Diff. [$10^{-6}$] |
| −3.35 | −2.25 | 11.0 | X = 0.2 mm | −3.15 | −2.30 | 8.5 |
| −3.35 | −2.35 | 10.0 | X = 2.6 mm | −3.15 | −2.50 | 6.5 |
| −3.44 | −2.45 | 9.9 | X = 5.3 mm | −3.20 | −2.50 | 7.0 |

As apparent from Table I, the differences between the minimum XX-strain and the maximum XX-strain is reduced with about 30%. So, using the protrusions as support for the droplet forming unit 3 reduces deformations in the droplet forming unit 3 due to differences in coefficient of thermal expansion resulting in an improved image quality.

Figure 5:
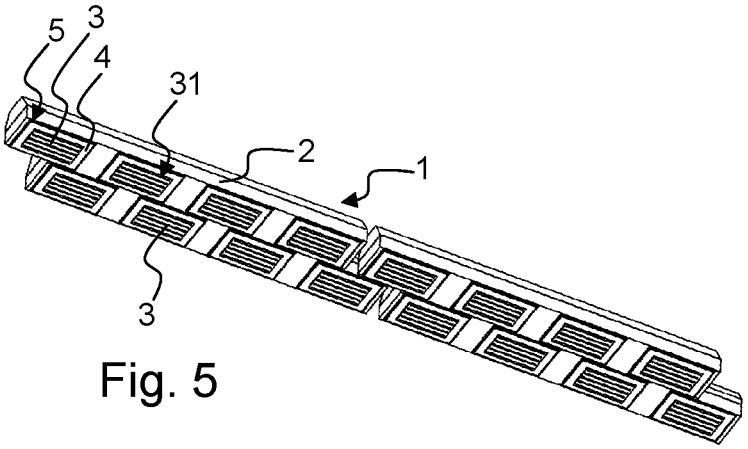
FIG. 5 shows a perspective view of a second embodiment of an inkjet print head.

FIG. 5 illustrates another embodiment, in which a number of droplet forming units 3 are arranged on a single ink supply substrate 2. Each droplet forming unit 3 is arranged on the ink supply substrate 2 with a flexible foil 5 and an intermediate element 4 interposed therebetween. Using suitable staggering of the chips, a virtually continuous row of orifices 31 may be created as is well known in the art. Further, with a suitable design as shown, multiple print heads may be positioned and aligned to create an even longer virtually continuous row.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet print head for generating a droplet of ink, the inkjet print head comprising:

an ink supply substrate;

a droplet forming unit arranged on the ink supply substrate, the droplet forming unit comprising:

a plurality of droplet ejection units, each droplet ejection unit comprising an ink flow path extending between an ink inlet port and an orifice; and a piezoelectric actuator being arranged on a membrane in operative communication with the ink flow path for generating a pressure wave in the ink in the ink flow path; and an intermediate element arranged between the ink supply substrate and the droplet forming unit, the intermediate element having a first element surface on which the droplet forming unit is arranged and the intermediate element having a second element surface opposite to the first element surface, the intermediate element being supported on the ink supply substrate at the second element surface, wherein the intermediate element is provided with a plurality of support protrusions at the second element surface.

2. The inkjet print head according to claim 1, wherein the droplet forming unit has an ink inlet surface, in which ink inlet surface each ink inlet port for receiving ink from the ink supply substrate is arranged, the ink inlet surface being arranged on the first element surface of the intermediate element.

3. The inkjet print head according to claim 2, wherein the intermediate element comprises an ink supply opening at the first element surface, the ink supply opening forming a manifold chamber for supplying ink to the ink inlet port of the droplet forming unit.

4. The inkjet print head according to claim 2, wherein the ink inlet surface of the droplet forming unit has an outer portion surrounding an ink inlet port portion, each ink inlet port being arranged in the ink inlet portion and wherein the support protrusions are arranged opposing said outer portion.

5. An inkjet print head for generating a droplet of ink, the inkjet print head comprising:

an ink supply substrate;

a droplet forming unit arranged on the ink supply substrate, the droplet forming unit comprising:

a plurality of droplet ejection units, each droplet ejection unit comprising an ink flow path extending between an ink inlet port and an orifice; and a piezoelectric actuator being arranged in operative communication with the ink flow path for generating a pressure wave in the ink in the ink flow path;

an intermediate element arranged between the ink supply substrate and the droplet forming unit, the intermediate element having a first element surface on which the droplet forming unit is arranged and the intermediate element having a second element surface opposite to the first element surface, the intermediate element being supported on the ink supply substrate at the second element surface; and an aperture in the intermediate element; and a plurality of support protrusions extending between the intermediate element and the ink supply substrate, the plurality of support protrusions arranged around the aperture.

6. The inkjet print head according to claim 5, further comprising a support ridge extending across aperture.

7. The inkjet print head according to claim 5, further comprising a flexible foil between the intermediate element and the ink supply substrate.

* * * * *